United States Patent [19]

Rojey

[11] 4,167,101

[45] Sep. 11, 1979

[54] ABSORPTION PROCESS FOR HEAT CONVERSION

[75] Inventor: Alexandre Rojey, Vanves, France

[73] Assignee: Institut Francais du Petrole, Rueil-Malmaison, France

[21] Appl. No.: 908,431

[22] Filed: May 22, 1978

Related U.S. Application Data

[63] Continuation of Ser. No. 711,826, Aug. 5, 1976, abandoned.

[30] Foreign Application Priority Data

Aug. 14, 1975 [FR] France ..... 75 25598

[51] Int. Cl.[2] ..... F25B 15/00

[52] U.S. Cl. ..... 62/102; 62/107; 62/114; 165/1; 165/107 R; 165/DIG. 17

[58] Field of Search ..... 62/102, 107, 114; 165/1, 2, 107, DIG. 17

[56] References Cited

U.S. PATENT DOCUMENTS 3,872,682 3/1975 Shook ..... 62/114

OTHER PUBLICATIONS

Althouse et al., Modern Refrigeration and Air Conditioning, The Goodheart Willcox Co., Inc., South Holland, Ill., 1975, pp. 606–608.

*Primary Examiner*—Leland A. Sebastian
*Attorney, Agent, or Firm*—Millen & White

[57] ABSTRACT

Heat available at a lower temperature level is converted to heat at a higher temperature level, by dissolving a gaseous fraction of a working fluid into a liquid phase, thereby producing heat at the higher temperature level, desorbing at least a portion of said gaseous fraction with a stripping gas, taking heat at said lower temperature level, fractionating the resulting gaseous mixture by partial liquefaction, separation and vaporization, into at least two gaseous fractions and recycling said fractions respectively as working fluid and as stripping gas.

22 Claims, 3 Drawing Figures

ABSORPTION PROCESS FOR HEAT CONVERSION

This is a continuation, or application Ser. No. 711,826, filed Aug. 5, 1976, now abandoned It frequently happens that substantial amounts of heat are lost due to the fact that the temperature level at which they are available is too low. Thus a refinery rejects a large part of the heat produced at a temperature level which may be, for example, from 50 to 150° C. and which is considered too low for re-use.

Similarly, in the geothermal field, there is the problem of how to employ hot water from underground water layers whose temperature is lower than that of the desired use.

The necessity of saving energy makes it desirable in any case to dispose means to increase the temperature at which a fluid is available. For this purpose, it is possible to proceed by employing a heat pump. By means of the heat pump, it is possible to use the heat at a temperature higher than that at hich it is originally available but this pump consumes power $W=Q/\eta$, Q being the amount of heat supplied and $\eta$ the performance coefficient of the heat pump. The power W is itself obtained in most cases from combustion heat with a yield which is substantially lower than 1, for example about 0.3. Under these conditions a system operated as heat pump has no significant interest as far as a power saving is concerned except if it is operated with a high performance coefficient.

Another procedure consists of operating according to the trithermal cycle by means of a thermal converter. The operativeness of such a thermal converter has been studied on a theoretical point of view by R. Vichnievsky (Thermodynamique appliquee aux machines—Masson et Cie 1967).

Such a system, exchanging heat with a cold source at an absolute temperature $T_o$ and operated under reversible conditions, provides for the conversion of an amount of heat Q at an absolute temperature T to an amount of heat Q' at a temperature T', according to the relation $$Q\left(1-\frac{T_o}{T}\right)=Q'\left(1-\frac{T_o}{T'}\right).$$

It is particularly possible to convert an amount Q of heat at a temperature T to a smaller heat amount Q' at a temperature T' higher than T, the ratio Q'/Q being necessarily lower than the theoretical ratio $$(1-T_o/T)/(1-T_o/T')$$

All the possible uses of such systems have not yet been fully explored in practice.

It has been discovered that it is possible to use an absorption system as a thermal converter whereby the temperature level of heat at a low level may be increased while proceeding in accordance with a substantially isobaric cycle. This is not possible according to any other known technique and requires a relatively small amount of mechanical power.

This invention relates to a process for producing heat at temperature A from heat available in a temperature range B, comprising the steps of (a) contacting a gaseous fraction of a working fluid with a liquid phase used as solvent so as to dissolve at least a portion of the gaseous phase into the liquid phase, thereby transferring heat at temperature A, (b) contacting the solution obtained from step (a) with a stripping gas stream so as to desorb at least a portion of said gaseous fraction of the working fluid and to obtain a gaseous mixture of said gaseous fraction of the working fluid with said stripping gas, the desorption heat being taken in the temperature range B, (c) subjecting the resulting gaseous mixture to fractionation by at least partial liquefaction, phase separation and vaporization, so as to obtain at least two separate gaseous fractions (G) and (H), said vaporization being performed by means of heat taken in the temperature range B and (d) feeding back the gaseous fraction (G) to step (a) as gaseous fraction of the working fluid and fraction (H) to step (b) as stripping gas stream.

The absorption heat produced in step (a) is not necessarily directly recovered in the absorption zone. It may also be used for vaporizing liquid constituents which are present, whose subsequent condensation permits to produce heat at a high temperature level (see example 3). Similarly, during step (b), the desorption heat is not necessarily directly supplied by the external heat source to the desorption zone.

The temperature or temperature range A may be selected, for example, within the range 80°–250° C., and the temperature or temperature range B, for example, within the range 20°–150° C.

When achieving heat exchange in a temperature range and not at a given temperature, it must be understood that the temperature range A is at least partly above the temperature range B.

The solvent will generally be a polar solvent, such for example as water, dimethylformamide, dimethylsulfoxide, N-methylpyrrolidone, tributylphosphate, ethylene glycol, diethyleneglycol, benzyl alcohol or aniline. It is also possible, in some cases, to make use as solvent of a hydrocarbon selected for example among the paraffins.

The absorbed fraction (G) which will be called solute or working fluid, may, for example, consist of ammonia, an alcohol such as methanol, a ketone such as acetone or a paraffinic hydrocarbon such, for example, as butane or propane, or an aromatic hydrocarbon such, for example, as benzene, or a vapor of chlorinated and/or fluorinated hydrocaron of the "freon" family such, for example, as fluorotrichloromethane or difluoro dichloromethane. As a general rule, any gas chemically stable at the operating temperature and pressure conditions may be convenient, provided that it can be dissolved in the solvent with evolution of heat, for example more than 50 calories per gram of absorbed solute and preferably as high as possible.

The desorption is performed by introducing a scavenging gas stream (H). Said scavenging stream (H) may consist of a gas not condensable at the temperature at which the desorption occurs, such for example as nitrogen or hydrogen. In this case, there is obtained a gaseous mixture formed by the scavenging stream (H) and the desorbed solute (G), the latter being separated therefrom by passing the mixture through a condenser cooled, for example, by an external cooling medium such as water or air. There is thus obtained, at the outlet from the condenser, a liquid fraction of solute (G) which is subsequently vaporized by making use of heat in the temperature range B. The scavenging stream (H) may also be formed of a vapor of one constituent condensable at the pressure of the system and at the cooling temperature of the condenser, which may be for example a hydrocarbon such as butane when a light gas such as ammonia is desorbed. The gaseous mixture formed by the scavenging gas and the desorbed solute is separated in such a case by passage through a condenser, cooled for example by means of the external cooling medium. There is thus obtained, at the outlet from the condenser, either a liquid fraction (H), which is subsequently vaporized by making use of heat in the temperature range B and reconstitutes the scavenging gas stream, and a gaseous fraction (G), or two liquid fractions (G) and (H) which are subsequently vaporized separately by making use of heat in the temperature range B.

The fractionation of the gaseous mixture may also be performed by any other known method such for example as distillation.

The contact between the liquid phase and the gaseous phase during the desorption of the solute is preferably conducted counter-currently so as to obtain the most complete desorption as possible. The absorption and desorption steps are preferably performed in columns of the type frequently used in chemical engineering to proceed with this type of operation, but other devices, particularly those comprising mechanical stirring, may also be used.

The invention will be illustrated by the following examples which describe the manner of performing such a system.

EXAMPLE 1

Figure 1:
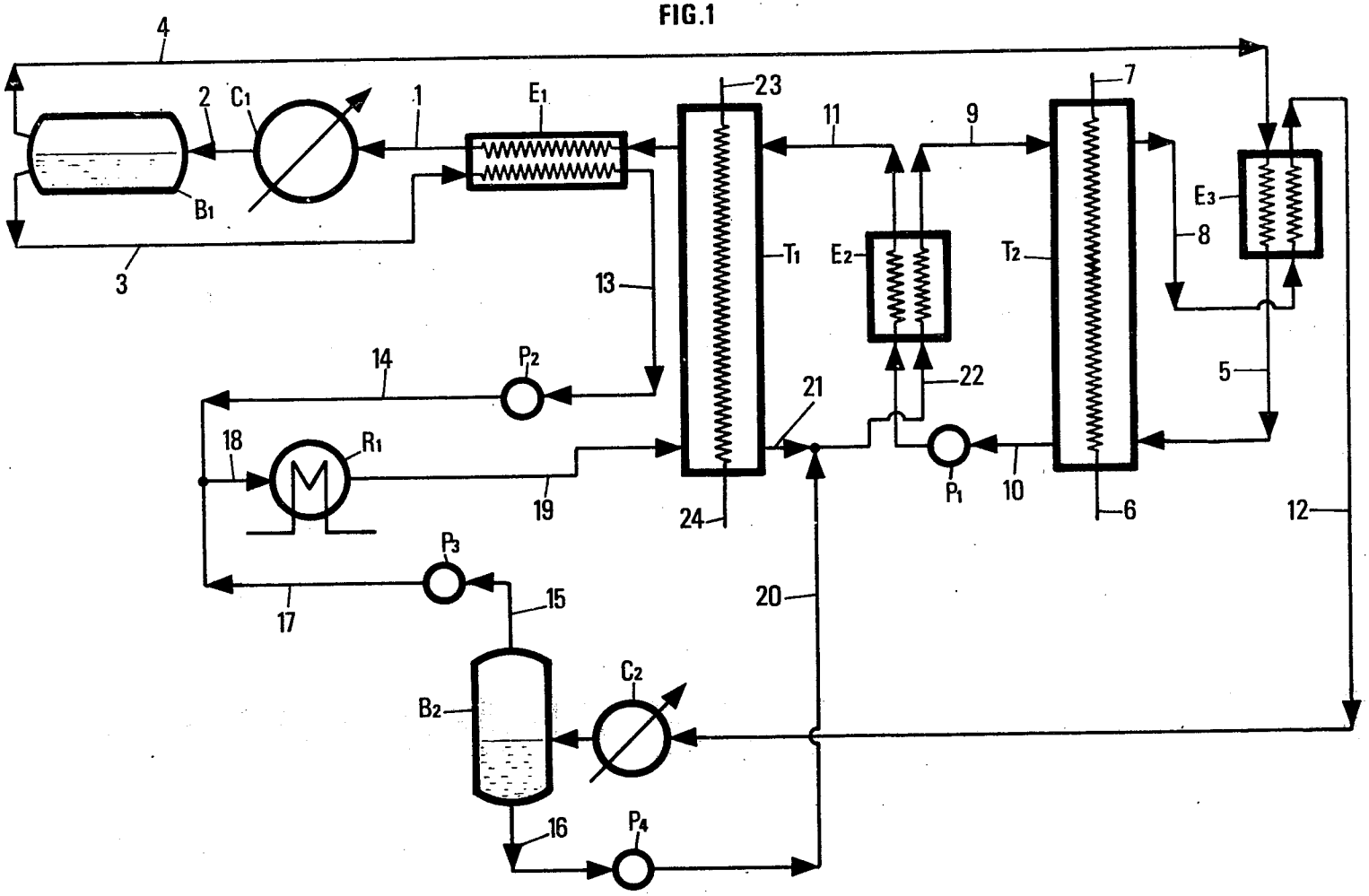
FIG. 1 illustrates the apparatus used in Example 1

This example is illustrated by FIG. 1. Through duct 1, there is introduced, at a pressure of 4 atm and at a temperature of 35° C., 23 $m^3/h$ of a gaseous mixture having the following composition by mole:

| | | |
|---|---|---|
| n-butane | : | 0.906 |
| ammonia | : | 0.077 |
| water | : | 0.017 |

This mixture is cooled down to a temperature of 25° C. in condenser C1 cooled with water. There is thus obtained a partial liquefaction of butane and the mixture is sent through duct 2 to the decantation flask B1. At the outlet from this flask there is obtained, through duct 3, liquid butane at a flow rate of 1698 kg/h and, through duct 4, a gaseous mixture having the following composition by mole:

| | | |
|---|---|---|
| n-butane | : | 0.575 |
| ammonia | : | 0.348 |
| water | : | 0.077 |

This gaseous mixture is passed through exchanger E3 from where it is discharged through duct 5 at a temperature of 54° C. and is sent to a plate column T2. This plate column T2 has a 10 cm diameter and comprises 15 perforated plates. In said column the gaseous mixture is counter-currently contacted with an aqueous phase supplied through duct 9. The flow rate of the aqueous phase is 241 liters/h. The ammonia contained in the gaseous mixture is absorbed by water and the gaseous mixture issued through duct 8 from the column has the following composition, by mole:

| | | |
|---|---|---|
| n-butane | : | 0.882 |
| water | : | 0.118 |

This mixture is passed through exchanger E3 from where it issues through duct 12 and then passes through condenser C2 in which it is condensed with transfer of heat by indirect contact with the cooling water of the condenser. There is thus obtained two liquid fractions which are separated in the flask B2.

From duct 16 there is recovered water at a flow rate of 9 liters/h, which is taken again by pump P4 and admixed in line with the aqueous solution issued from column T1 through duct 21. From duct 15, there is recovered butane at a flow rate of 382 liters/h, which is taken again by pump P3 which supplies it to duct 17 for admixture in line with butane supplied from duct 14.

The plate column T2 is operated at a top pressure of 3.8 atm. and the plates are at a substantially constant temperature of 80° C. The dissolution heat is exhausted through indirect contact exchange with a n-pentane stream entering through duct 6 and issuing through duct 7, while vaporizing during exchange. It thus provides 4.5 kcal/s at 80° C.

The ammonia aqueous solution is discharged through duct 10, taken again by pump P1, subsequently passed through exchanger E2 from where it issues at a temperature of 51° C. and then sent through duct 11 to the plate column T1.

The plate column T1 has a 10 cm diameter and comprises 15 perforated plates.

The liquid butane discharged from flask B1 is sent, through duct 3, to exchanger E1 from where it issues through duct 13 at a temperature of 35° C., and is taken again by pump P2 which sends it to duct 14. Butane supplied through duct 14 and butane delivered from duct 17 are admixed in line and sent, through duct 18, to boiler R1 in which butane is vaporized under a pressure of 4.2 atm. while absorbing 39.9 keal/s at a temperature of 43° C. from the heat source of the boiler. The vaporized butane is sent through duct 19 to the plate column T1. In column T1, ammonia contained in the aqueous solution, supplied from duct 11 is desorbed by the butane stream. The plate column T1 is operated at a bottom pressure of 4.2 atm. and the plates are at a substantially constant temperature of 40° C. The desorption heat, i.e. 4.6 kcal/s, is supplied by an iso Pentane stream entering through duct 24 and issuing through duct 23 while being condensed during the whole exchange step.

This system has accordingly produced heat at 80° C. from heat at a temperature from 40° to 43° C.

EXAMPLE 2

Figure 2:
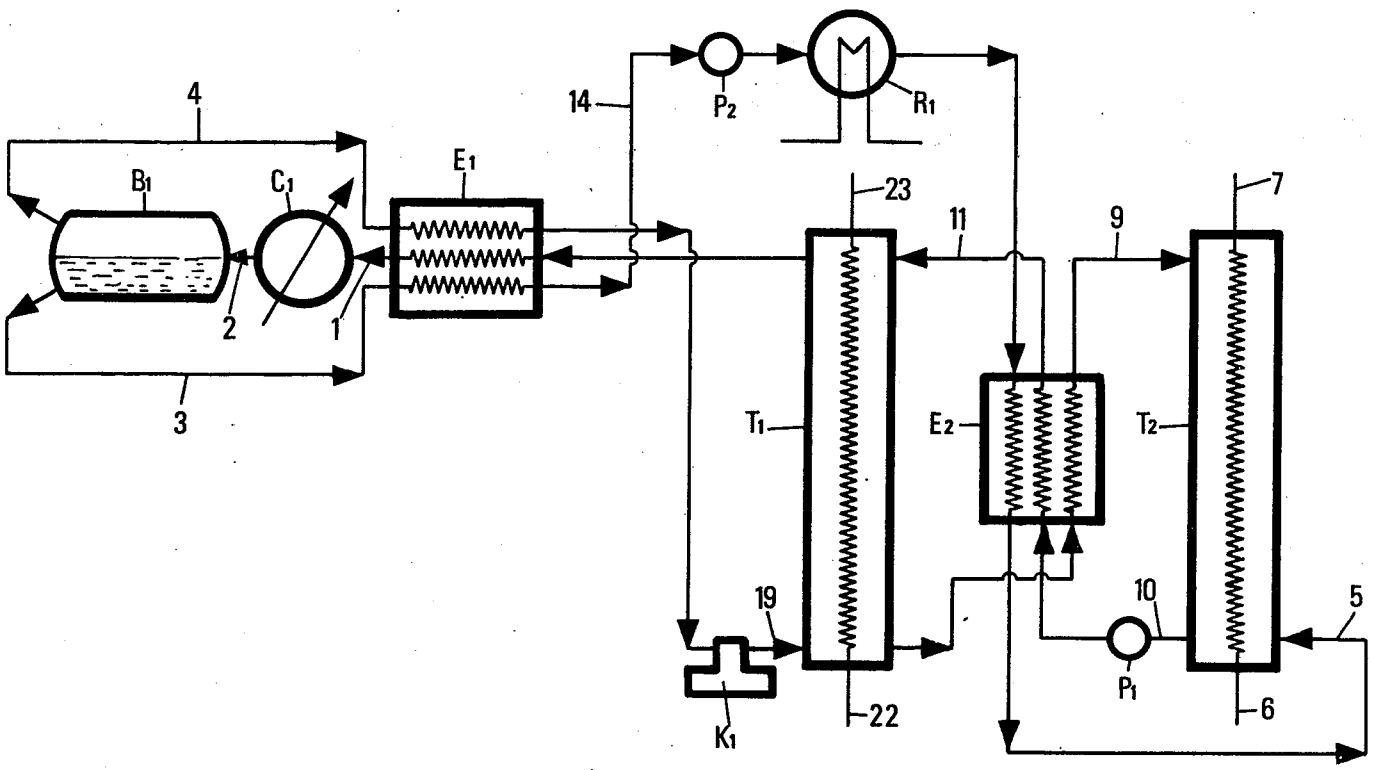
FIG. 2 illustrates the apparatus used in Example 2

Example 2 is illustrated by FIG. 2. A stream of 12 $m^3/h$ of a gaseous mixture at a pressure of 10 atm and a temperature of 24° C. is supplied through duct 1. The composition of this mixture is as follows by mole:

| | | |
|---|---|---|
| nitrogen | : | 0.73 |
| n-butane | : | 0.27 |

This mixture is cooled down to a temperature of 15° C. in condenser C1. There is thus obtained a butane liquid fraction and the mixture is sent through duct 2 to decantation flask B1. From this flask issues, through duct 3, at a flow rate of 33.1 kg/h, liquid butane and, through duct 4, a gaseous mixture having the following composition by mole:

| | | |
|---|---|---|
| nitrogen | : | 0.83 |
| n-butane | : | 0.17 |

Liquid butane issuing from flask B1 passes through exchanger E1 from where it issues, through duct 14, at a temperature of 75° C. and is then taken again by pump P2 and sent to boiler R1, in which it is vaporized under a pressure of 9.8 atm., while absorbing 638 cal/s at a temperature of 79.5° C. from the heat source of the boiler and the vaporized butane is sent, through duct 5, to column T2. Column T2 is a packed column of a 10 cm diameter filled up with Raschig rings of 0.6 cm diameter. Column T2 is operated at a pressure of 9.9 atm. at its base and at a substantially constant temperature of 120° C. Butane dissolves in a stream of n-decane flowed counter-currently and supplied from duct 9 to column T2. The n-decane flow rate is 414 kg/h. The dissolution heat of butane is absorbed by a water stream entering through duct 6 and issuing through duct 7, while vaporizing during the exchange. There is thus produced 187 cal/s at 120° C. The butane solution in n-decane is discharged through duct 10, taken again by pump P1, passed through exchanger E2 and sent through duct 11 to column T1. Column T1 is a packed column of a 10 cm diameter filled up with Raschig rings of 0.6 cm diameter. The gaseous mixture of nitrogen and butane issued from flask B1 through duct 4 passes through exchanger E1 from where it is discharged at a pressure of 9.7 atm. and then recompressed by recompressor X1 up to a pressure of 10.5 atm. and sent through duct 19 to column T1. In column T1, the butane contained in the n-decane is desorbed partly by the gas stream. Column T1 is operated at a substantially constant temperature of about 80° C. and the desorption heat, i.e., 374 cal/s, is supplied by a stream of heptane which enters as vapor through duct 22 and is discharged through duct 23 while being condensed during the exchange.

Accordingly the system has delivered heat at 120° C. while being fed with heat at 80° C.

EXAMPLE 3

Figure 3:
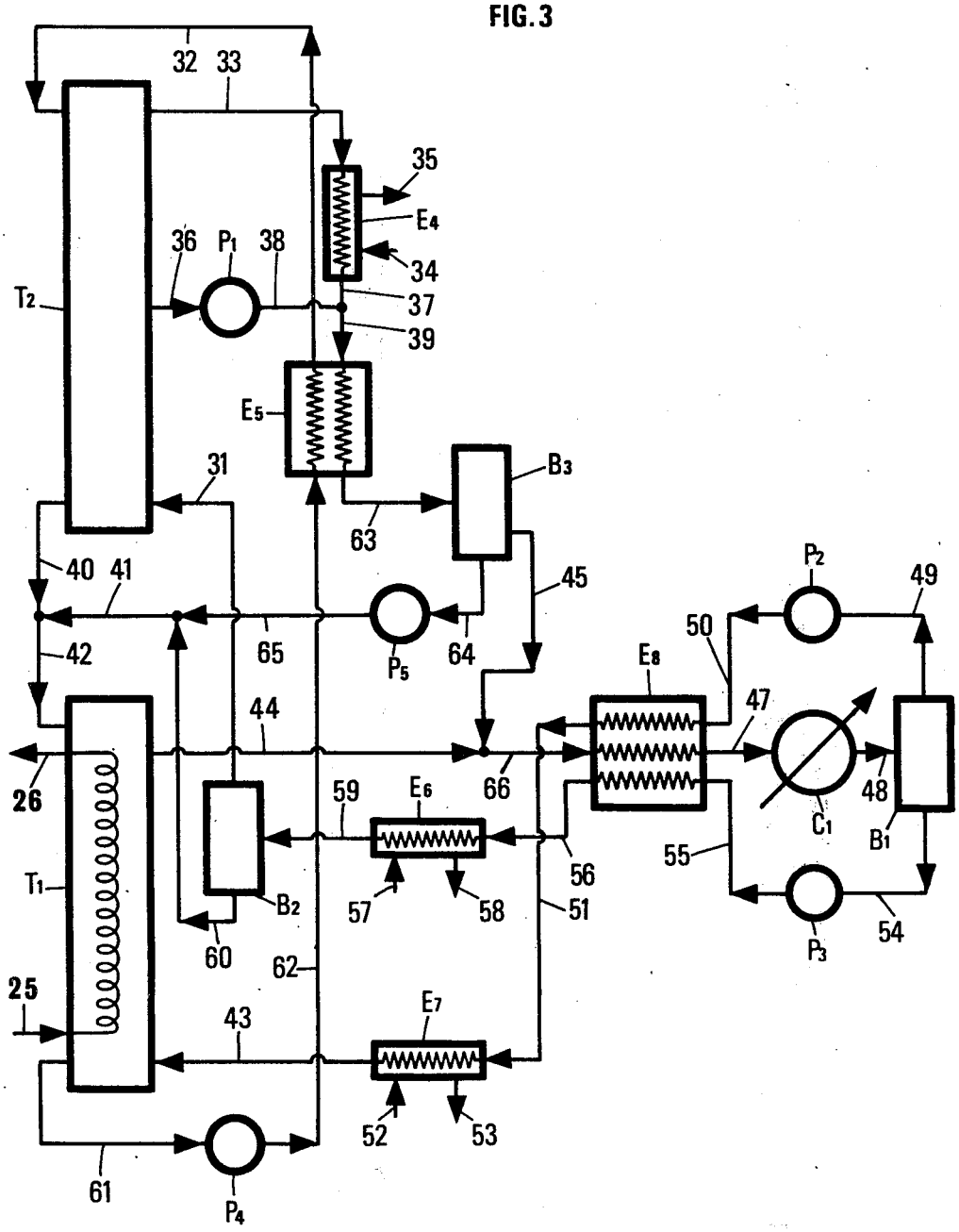
FIG. 3 illustrates the apparatus used in Example 3.

Example 3 is illustrated by FIG. 3. A stream of 1.31 metric tons/h of vapor containing 79% by weight of ammonia and 31% of water is conveyed through duct 31 to the absorption column T2, at a temperature of 100° C. and under a pressure of 4.5 kg/cm$^2$. At the top of the absorption column T1, there is supplied, through duct 32, a liquid stream of 10 metric tons/h of water containing 0.2% by weight of ammonia, said stream being at a temperature of 113° C. Column T1 is adiabatic and, as a result of the heat produced by ammonia absorption, water vaporizes. At the top of the column, the temperature is 140° C., the pressure 4 kg/cm$^2$ and there is delivered, through duct 33, one metric ton/h of vapor consisting of 95% b.w. of water and 5% b.w. of ammonia. This vapor is condensed at a temperature from 140° to 130° C. in exchanger E4, while transferring 525 keal/h to an external fluid fed through duct 34 and discharged through duct 35, and then issues from exchanger E4 through duct 37. Through duct 36 there is withdrawn from the column, by means of pump P1, a liquid stream at a flow rate of 7.2 metric tons per hour at a level of the column where temperature is 120° C. This liquid stream is fed through pump P1 to duct 38 and admixed in line with the liquid stream supplied through duct 37, the resulting mixture being sent through duct 39 to exchanger E5.

At the bottom of the column, there is withdrawn a 15% b.w. ammonia solution, at a temperature of 100° C. This solution is discharged through duct 40 and admixed in line with the liquid stream supplied from duct 41. The resulting mixture is sent to the top of the stripping column T1 through duct 42.

At the bottom of the column T1, there is supplied 151 Kmoles/h of a stripping vapor through duct 43. The composition by mole of this vapor is as follows:

| | | |
|---|---|---|
| Normal butane | : | 0.30 |
| Isopentane | : | 0.45 |
| Normal hexane | : | 0.25 |

This vapor may be used to strip the ammonia contained in the solution. The description heat is compensated by the supply of 646 Kcal/h resulting from the cooling of an external fluid fed through duct 25 and discharged through duct 26. The temperature in the column is thus 100° C. at the bottom and 80° C. at the top. Through duct 44, there is discharged a vapor whose composition by mole is as follows:

| | | |
|---|---|---|
| Hydrocarbons | : | 0.67 |
| Ammonia | : | 0.26 |
| Water | : | 0.07 |

This vapor is admixed with 1.13 metric ton/h of solution, supplied through duct 25, so as to bring the ratio by weight of ammonia to (water+ammonia) to 0.45. The mixture is fed through duct 66 to exchanger E8 and then through duct 47 to condenser C1. At the outlet of the condenser, the temperature is 30° C. and the mixture is separated into two liquid phases, a hydrocarbon fraction and an aqueous fraction consisting of an ammonia solution. These two liquid fractions are supplied, through duct 48, to flask B1. The hydrocarbon phase is discharged from flask B1 through duct 49, and then sent by pump P2, through duct 50 to exchanger E8 and through duct 51 to exchanger E7. In exchanger E7, it is heated by means of an external fluid fed through duct 52, discharged through duct 53 and whose cooling produces 856 kcal/h. It issues from exchanger E7 through duct 43 completely vaporized at 100° C. The aqueous phase is discharged from flask B1 through duct 54 and is sent by pump P3 through duct 55 to exchanger E9 and from there, through duct 56 to exchanger E6. In exchanger E6 it is heated by an external fluid which is fed through duct 57, discharged through duct 58 and whose cooling produces 158 kcal/h, and finally it is sent, through duct 59, to flask B2. The temperature in flask B2 is 100° C. and there is obtained a vapor which is sent, through duct 31, to column T2 and a liquid fraction containing 16% by weight of ammonia which is sent, through duct 60, to column T1.

At the bottom of column T1 there is obtained a solution having a 0.2% b.w. ammonia content, which is discharged from the column through duct 61. This solution is taken again by pump P4 and sent, through duct 62, to exchanger E5 from where it is conveyed, through duct 32, to column T2.

Exchanger E5 is also fed, through duct 39, with the top solution. This solution is sent, through duct 63, to flask B3 from where there is withdrawn, through duct 45, the necessary amount to dilute the vapor issuing from the top of column T1. Through duct 64 there is discharged 7.07 metric tons/h of solution which is sent by pump P5 and duct 65 to the top of column T1.

Finally heat has been produced at the temperature from 130° to 140° C. (temperature range A) by consuming heat at a temperature from 80° to 100° C. (temperature range B).

It is apparent, from these examples that, by the process of the invention, it is possible to produce heat at relatively high temperatures while operating under a reasonable pressure so that the cost of the apparatus is not too high. It also appears that the absorption and desorption steps may be conducted at substantially identical pressure, whereby it is possible to save the compression work. It is also obvious from example 3 that in some cases, in order to make easier the desorption, it is possible to proceed to said desorption at a pressure lower than the pressure at which is conducted the absorption step.

What I claim is:

1. A process for producing heat at a temperature A from a heat source available at a temperature B, the temperature A being above the temperature B, comprising the steps of:

(a) contacting a gaseous fraction (G) of a working fluid as defined in step (d) with a liquid phase solvent as defined in step (e), in an absorption zone to absorb at least a portion of the gaseous fraction in the solvent so as to obtain a solution of the working fluid in the solvent and to evolve heat, and transferring at least a portion of the evolved heat at temperature A to an external heat receiving medium;

(b) passing the resultant solution from step (a) to a stripping zone and contacting it with a stripping gas (H) as defined in step (d) so as to desorb at least a portion of said gaseous fraction of the working fluid and to obtain (i) a gaseous mixture of said gaseous fraction of the working fluid with said stripping gas and (ii) a desorbed solution, and compensating for the endothermal heat of desorption by indirectly transferring said heat available at the temperature B to the stripping zone;

(c) subjecting the resultant gaseous mixture from step (b) to: (i) at least partial liquefaction by indirect heat exchange contact with an external cooling medium; (ii) phase separation; and (iii) vaporization of resultant liquid; in order to obtain at least two separate gaseous fractions, a gaseous fraction (G) of the working fluid and a stripping gas (H), said vaporization being conducted by indirect heat transfer against said heat available at the temperature B;

(d) recycling the gaseous fraction (G) to step (a) as said gaseous fraction of the working fluid and the fraction (H) to step (b) as the stripping gas; and (e) recycling the desorbed solution of step (b) to step (a) to reconstitute at least a portion of said liquid phase solvent.

2. A process according to claim 1, in which the fractionation in step (c) is performed by partial liquefaction, whereby fractions G and H are respectively produced one in the gaseous state and the other in the liquid state, followed with a separation of the gaseous fraction (G or H) and of the liquid fraction (H or G) and with a vaporization of the separated liquid fraction so as to obtain a second gaseous fraction (H or G), said vaporization being obtained by taking heat in the temperature B.

3. A process according to claim 1, in which the desorption of step (b) is conducted by counter-current contact between the solution and the stripping gas stream.

4. A process according to claim 1, in which at least one of the constituents of the gaseous fraction which is absorbed in step (a) while transferring heat at temperature A, is ammonia.

5. A process according to claim 1, in which at least one of the constituents of the gaseous fraction which is absorbed in step (a) while transferring heat at a temperature A, is a hydrocarbon.

6. A process according to claim 1, in which at least one of the constituents of the gaseous fraction which is absorbed while transferring heat at a temperature A, is a chlorinated and/or fluorinated hydrocarbon.

7. A process according to claim 1, in which the stripping gas stream used for desorption in step (b) comprises a gaseous hydrocarbon.

8. A process according to claim 1, in which the stripping gas stream which is used for desorption in step (b) comprises nitrogen or hydrogen.

9. A process according to claim 1, in which one of the constituents of the liquid phase used as solvent is a polar solvent.

10. A process according to claim 1, in which at least one of the constituents of the liquid phase used as solvent is water.

11. A process according to claim 1, in which at least one of the constituents of the liquid phase used as solvent is a hydrocarbon.

12. A process according to claim 1, in which the prevailing pressure is from 1 to 50 absolute bars.

13. A process according to claim 1, in which the temperature A is from 80° to 250° C. and the temperature B is from 20° to 150° C.

14. A process according to claim 1, comprising, during step (c), liquefying fraction (H), separating it from the non liquefied fraction (G) and vaporizing fraction (H) while absorbing heat in the temperature range B.

15. A process according to claim 1, comprising, during step (C), liquefying fraction (G), separating it from the non liquefied fraction (H) and vaporizing fraction (G), while absorbing heat in the temperature B.

16. A process according to claim 1, comprising, during step (C), liquefying fractions (G) and (H), separating said fractions and vaporizing them separately by absorbing heat in the temperature B.

17. A process according to claim 1, wherein the stripping gas stream used for desorption in step (b) comprises a vapor, said vapor being condensable at the temperature of the external cooling medium under the prevailing pressure.

18. A process for producing heat at a temperature A from a heat source available at a temperature B, the temperature A being above the temperature B, comprising the steps of:

(a) contacting an ammonia gas fraction as defined in step (d) with a desorbed aqueous solution as defined in step (e), in an absorption zone, to absorb at least a portion of said ammonia gas fraction in said desorbed aqueous solution so as to obtain an aqueous ammonia solution and to evolve heat, and transferring at least a portion of the evolved heat at temperature A to an external heat receiving medium;

(b) passing the resultant solution from step (a) to a stripping zone and contacting it with a stripping hydrocarbon gas fraction as defined in step (d) so as to desorb at least a portion of said ammonia gas fraction and to obtain (i) a gaseous mixture of said ammonia gas fraction with said stripping hydrocarbon gas and (ii) a desorbed aqueous solution, and compensating for the endothermal heat of desorption by indirectly transferring said heat available at the temperature B to the stripping zone;

(c) subjecting the resultant gaseous mixture from step (b) to: (i) at least partial liquefaction by indirect heat exchange contact with an external cooling medium; (ii) phase separation; and (iii) vaporization of resultant liquid; in order to obtain separately an ammonia gas fraction (G) and a hydrocarbon gas fraction (H), said vaporization being conducted by indirect heat transfer against said heat available at the temperature B;

(d) recycling the fraction (G) to step (a) as said ammonia gas fraction and the fraction (H) to step (b) as the stripping hydrocarbon gas fraction; and (e) recycling the desorbed solution of step (b) to step (a) to reconstitute said desorbed aqueous solution.

19. A process according to claim 18, wherein the hydrocarbon gas fraction comprises the vapor of at least one hydrocarbon which is condensable at the temperature of the external cooling medium.

20. A process according to claim 18, wherein the contacting of step (b) is conducted by counter-current contact of said hydrocarbon gas with said resultant solution from step (a).

21. A process according to claim 18, wherein the temperature A is from 80° to 250° C. and the temperature B is from 20° to 150° C., provided said temperature A is above said temperature B.

22. A process according to claim 19, wherein, during step (c), said hydrocarbon gas fraction and said ammonia gas fraction are both liquefied, the resulting liquid phases are separated and the separated liquid phases are each vaporized to yield the separate gas fractions (G) and (H).

* * * * *

UNITED STATES PATENT AND TRADEMARK OFFICE

CERTIFICATE OF CORRECTION

PATENT NO. : 4,167,101

DATED : September 11, 1979

INVENTOR(S) : Alexandre Rojey

It is certified that error appears in the above-identified patent and that said Letters Patent are hereby corrected as shown below:

Claim 14, line 44: reads "(H) while absorbing heat in the temperature range B."
should read -- (H) while absorbing heat in the temperature B. --

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*